United States Patent [19]

Davies

[11] 4,339,070

[45] Jul. 13, 1982

[54] CARTON HAVING INTEGRALLY FORMED SUPPLEMENTARY COMPONENTS

[75] Inventor: Frank H. Davies, Toronto, Canada

[73] Assignee: Lawson Paper Converters Limited, Scarborough, Canada

[21] Appl. No.: 174,646

[22] Filed: Aug. 1, 1980

[51] Int. Cl.[3] ..... B65D 5/46

[52] U.S. Cl. ..... 229/52 B; 229/52 A

[58] Field of Search ..... 229/52 A, 52 B, 17 SC, 229/7 SC

[56] References Cited

U.S. PATENT DOCUMENTS

| | | | |
|---|---|---|---|
| 1,007,390 | 10/1911 | Robinson | 229/17 SC |
| 2,645,407 | 7/1953 | Bergstein | 229/52 A |
| 2,760,716 | 8/1956 | Weiner | 229/52 A |
| 2,903,175 | 9/1959 | Peimer | 229/17 SC |
| 2,950,851 | 8/1960 | Peimer | 229/17 SC |
| 3,300,119 | 1/1967 | Chaussadas | 229/52 B |
| 3,371,846 | 3/1968 | Detzel | 229/52 B |

FOREIGN PATENT DOCUMENTS

| | | | |
|---|---|---|---|
| 1429884 | 1/1966 | France | 229/52 B |

*Primary Examiner*—Herbert F. Ross

*Attorney, Agent, or Firm*—Dennison, Meserole, Pollack & Scheiner

[57] ABSTRACT

A supplementary component such as a handle or a pouring spout is provided on a carton formed from a unitary blank. The component is die cut into a flap and retained in position by deformable bridge members. Upon folding of the blank into a carton, access to the component is provided which permits it to be grasped to sever the deformable connections. In the case of a handle, the one flap is folded under another flap and an aperture provided in the other flap to permit access. Restraining means act between the two flaps to prevent separation of the handle from the carton.

19 Claims, 26 Drawing Figures

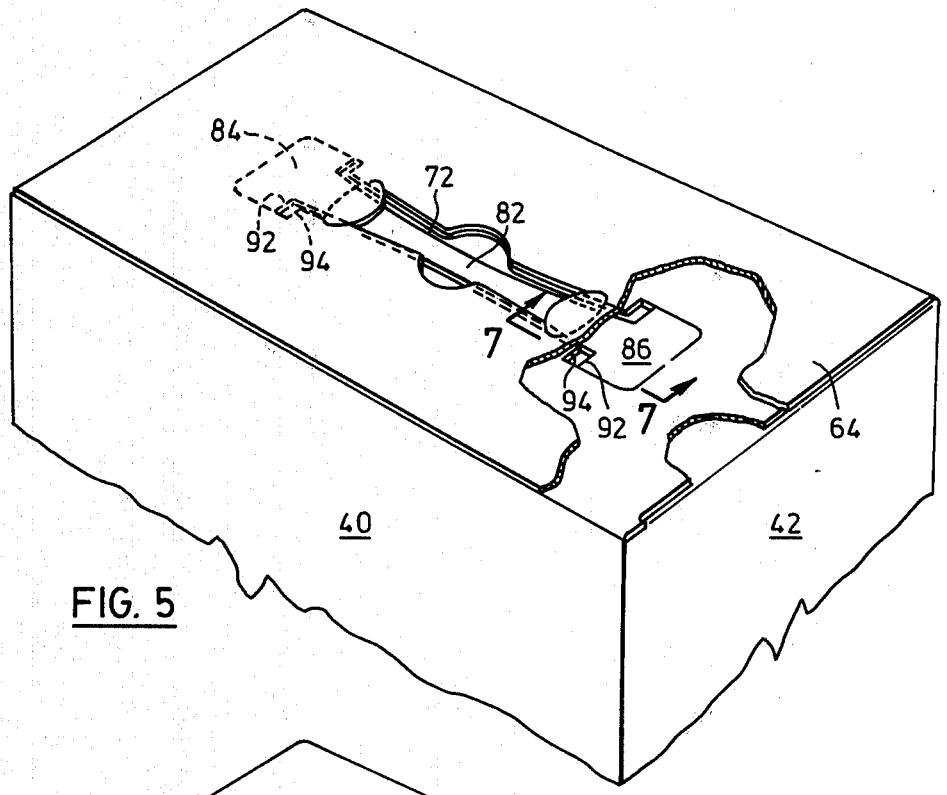
FIG. 5
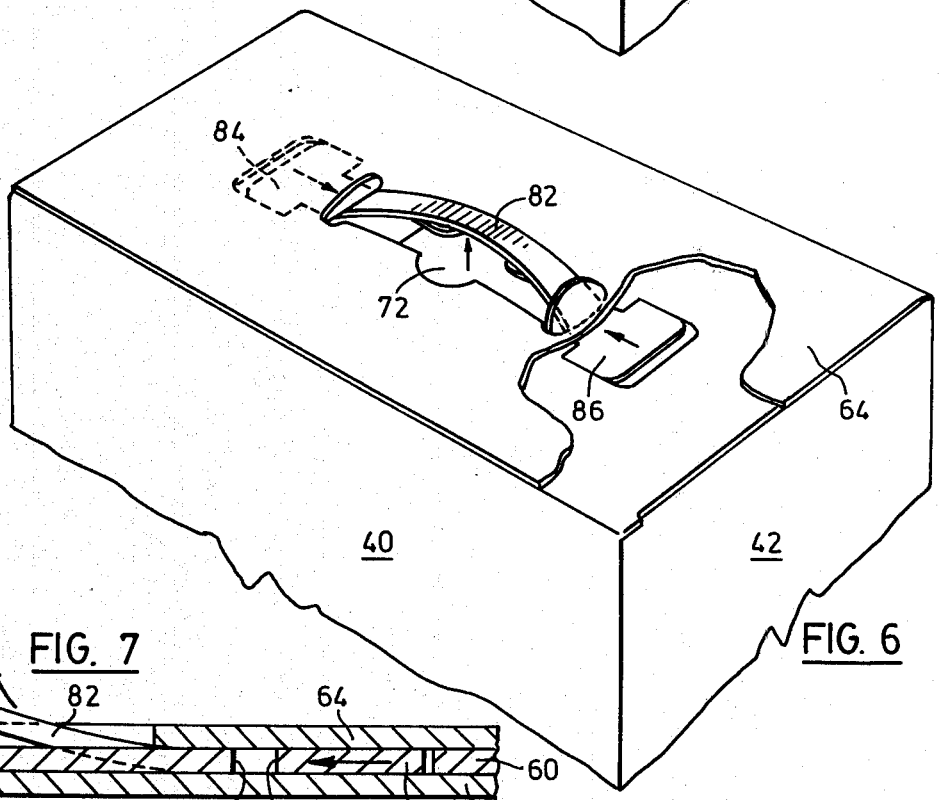
FIG. 6
FIG. 7
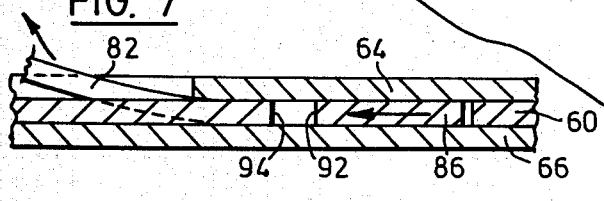

CARTON HAVING INTEGRALLY FORMED SUPPLEMENTARY COMPONENTS

The present invention relates to cartons and methods of making cartons. More particularly the invention relates to cartons in which supplementary components on the carton are required, for example to assist in transporting the carton or emptying its contents.

It is well known to manufacture a carton by passing a web of material through a printing press to print the required information on the carton, passing the web through a die-cutting press to die cut a blank from the web with appropriate shape, fold lines and apertures, and subsequently assembling the blank in a folding and gluing machine to form a carton. The carton is usually left open at one end to facilitate filling and sealed after the contents are placed into it.

The size of such cartons in general use has tended to increase with the demand for bulk purchase of commodities. One area of particular interest is the soap powder or detergent industry where soap powder is commonly retailed in cartons of six liter capacity or greater. These cartons are bulky and therefore a handle is provided to facilitate carrying.

One common method of providing a handle is to adhere a plastic handle to the upper end of the carton. Whilst this provides a suitable carrying handle for the carton, its use causes some difficulties in manufacture. The handle is a separate component which must be manufactured remote from the carton, and therefore necessarily adds to the cost of the carton. The handle must also be placed on to the carton in the appropriate location during assembly and manufacture of the carton. This requires a separate handling operation and adaption of the machinery to accommodate the handle. It will be appreciated that the carton blank is essentially planar and therefore easily handled. The addition of the handle provides a protuberance on the blank which causes some difficulty in its subsequent handling. As a result of these difficulties the production of such cartons has been depressed and their cost increased.

A further area in which components additional to the blank are required is the provision of a pouring spout to enable the contents to be removed in a controlled manner. One approach has been to provide a line of weakness at one corner of the carton so that, that portion of the carton can be torn away. This can result in spillage of the contents as the flap is torn open, particularly when the carton is full, and does not permit resealing of the carton.

Another approach has been the provision of a metal or plastic spout attached to the carton at a suitable location. Whilst this does permit resealing of the carton it presents similar problems of manufacture as the plastic carrying handle discussed above.

It is therefore an object of the present invention to obviate or mitigate the above disadvantages and provide a carton in which supplementary components, such as handles and pouring spouts, may be provided in a simple and effective manner.

The present invention therefore provides a carton in which the supplementary component is integrally formed with carton. The web of material is formed into a blank which includes a pair of flaps arranged to overlie one another to seal the end of the carton. An aperture is cut in one of the flaps during formation of the blank and an appropriate shape for the supplementary component cut into the other flap. A portion of the other flap is removed to provide a pair of abutment edges and permit relative movement between the cut-out portion and the remainder of the flap. The cut-out portion is retained in place by deformable connections, which may be foldable or severable bridge pieces and the flaps folded so that access to the supplementary component is possible through the aperture in the one flap. Upon application of a force to the cut-out portion the bridge members yield and permit movement of the cut-out relative to the other flap. This enables a handle or pouring spout to be provided and, in the case of a pouring spout, offers the possibility of resealing the carton.

In the case of a handle, the cut-out portion may be locally reinforced by application of a tape to the portion of the other flap which will subsequently form the cut-out portion. This can be accomplished after printing but before the blank is formed by applying a length of adhesive tape to the flap as it passes between the printing and die cutting stages.

It will be appreciated that the blank maintains its planar configuration during printing and die cutting and that conventional folding and glueing can be used to assemble the carton. The supplementary components are provided without separate preformed items so that formation and assembly of the carton is speeded up and the overall cost reduced.

Embodiments of the invention will now be described by way of example only with reference to the accompanying drawings in which.

Figure 1:
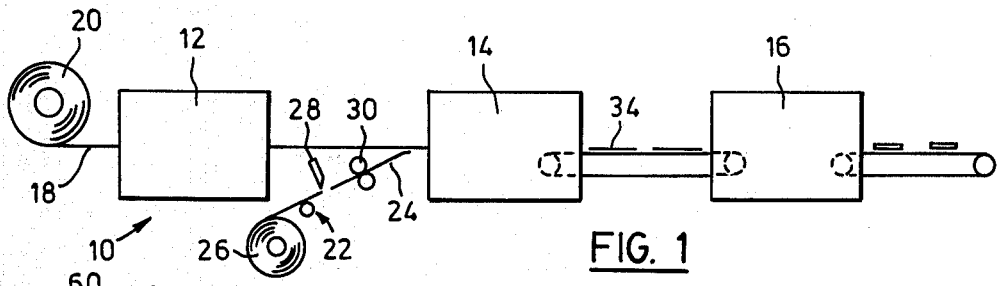
FIG. 1 is a diagrammatic representation of a machine to produce blanks from a web of material and fold them into a carton.
Figure 2:
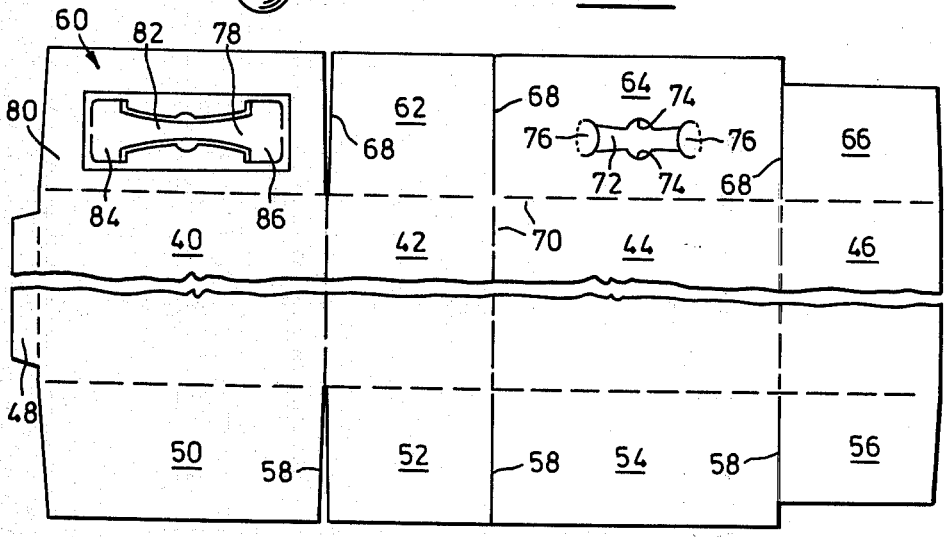
FIG. 2 is a plan view of a blank produced on the machine of FIG. 1 and designed to provide a carton with a handle.
Figure 3:
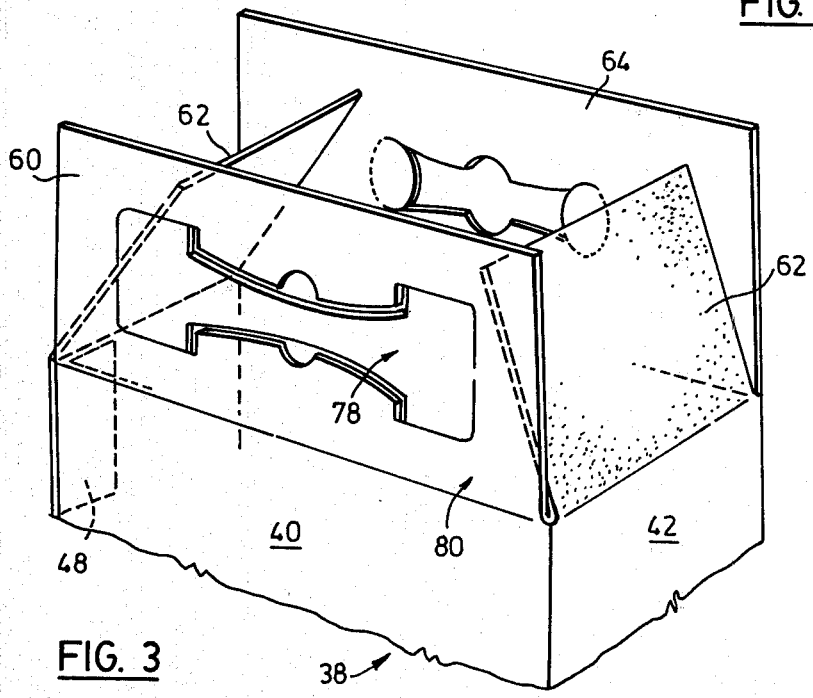
Figure 2A:
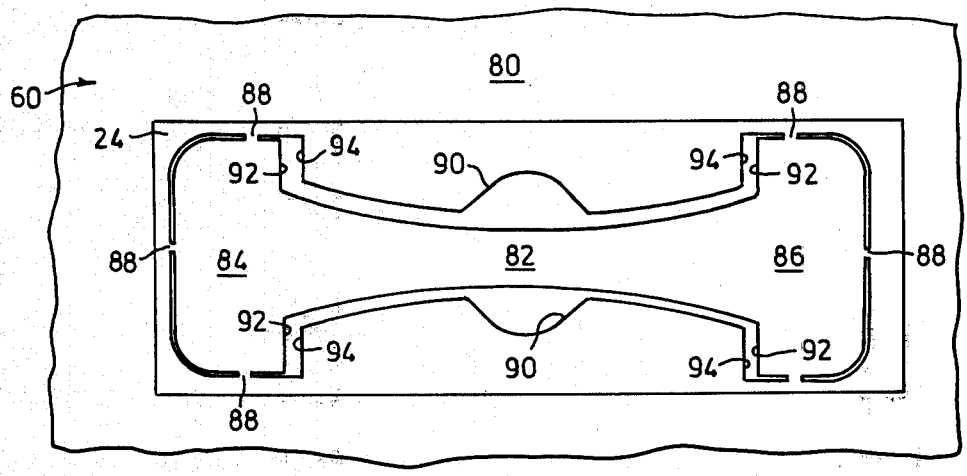
Figure 4:
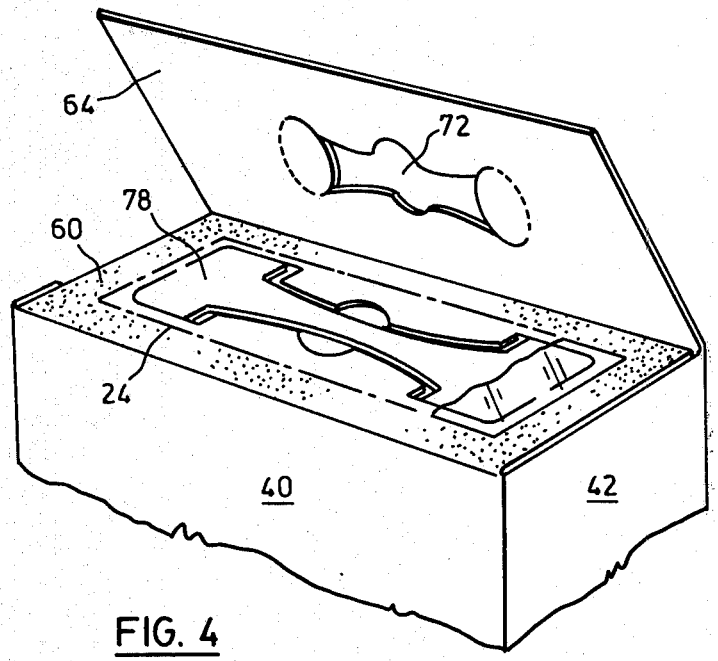
Figure 8:
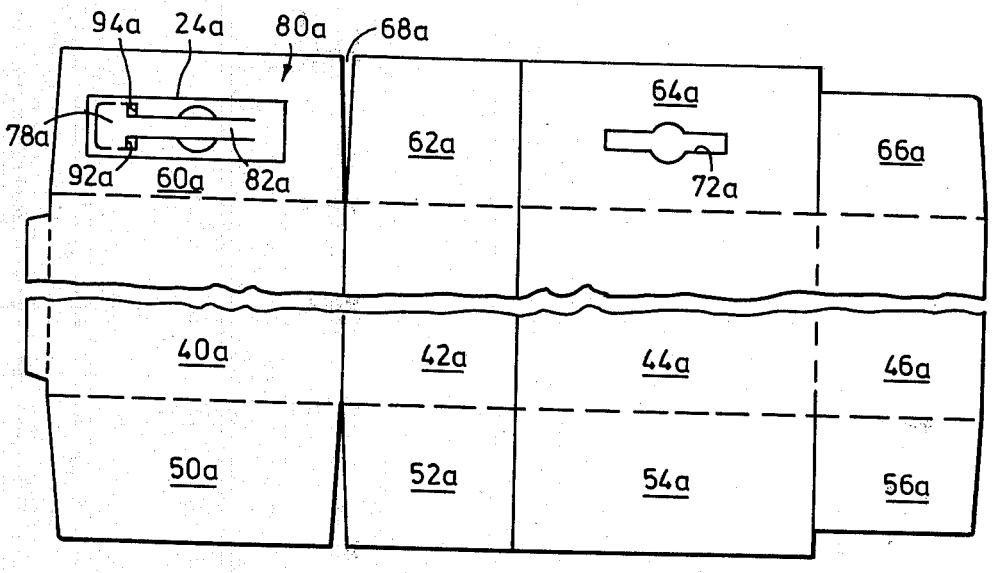
Figure 11:
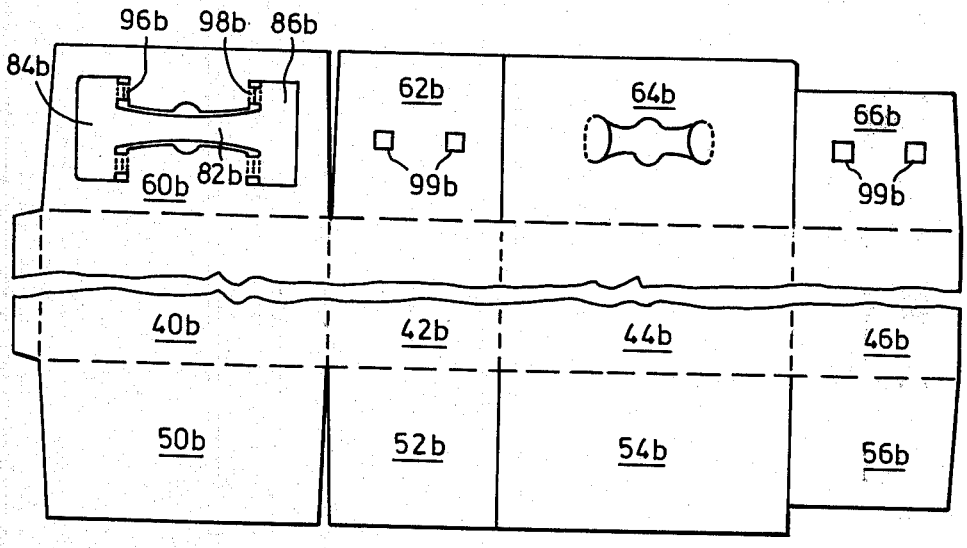
Figure 9:
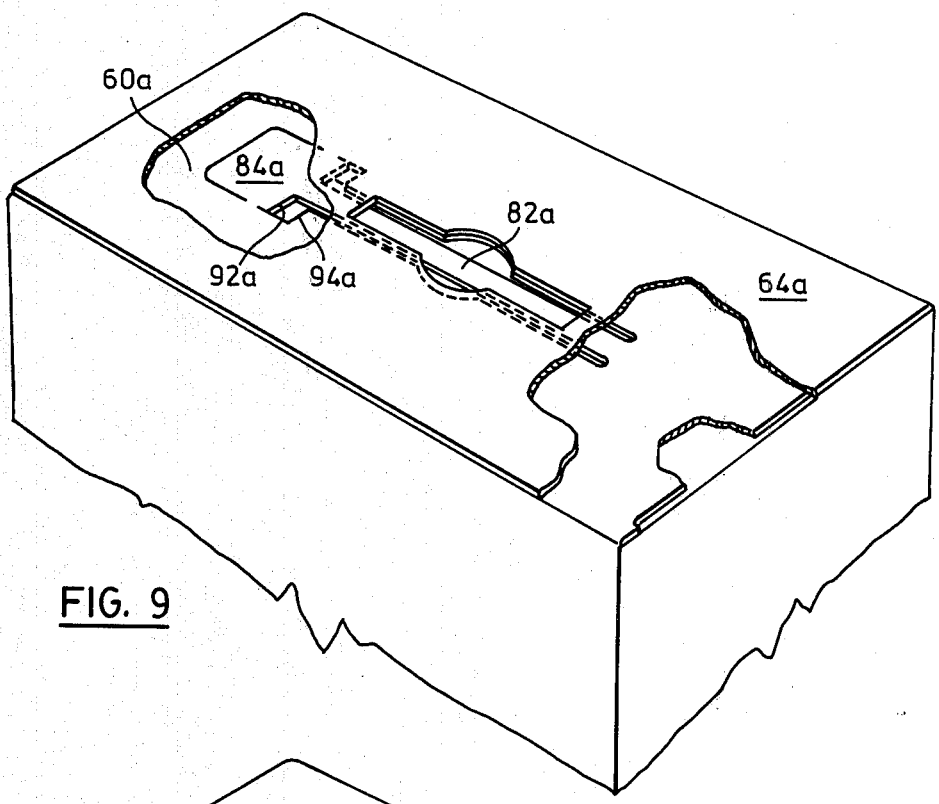
Figure 10:
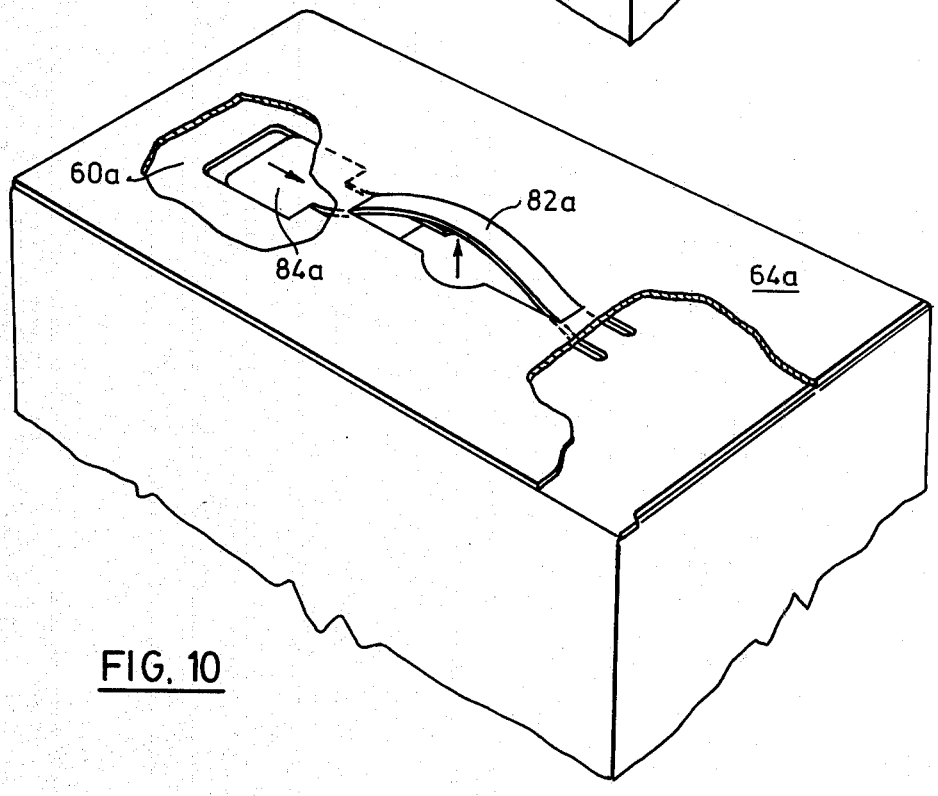
Figure 12:
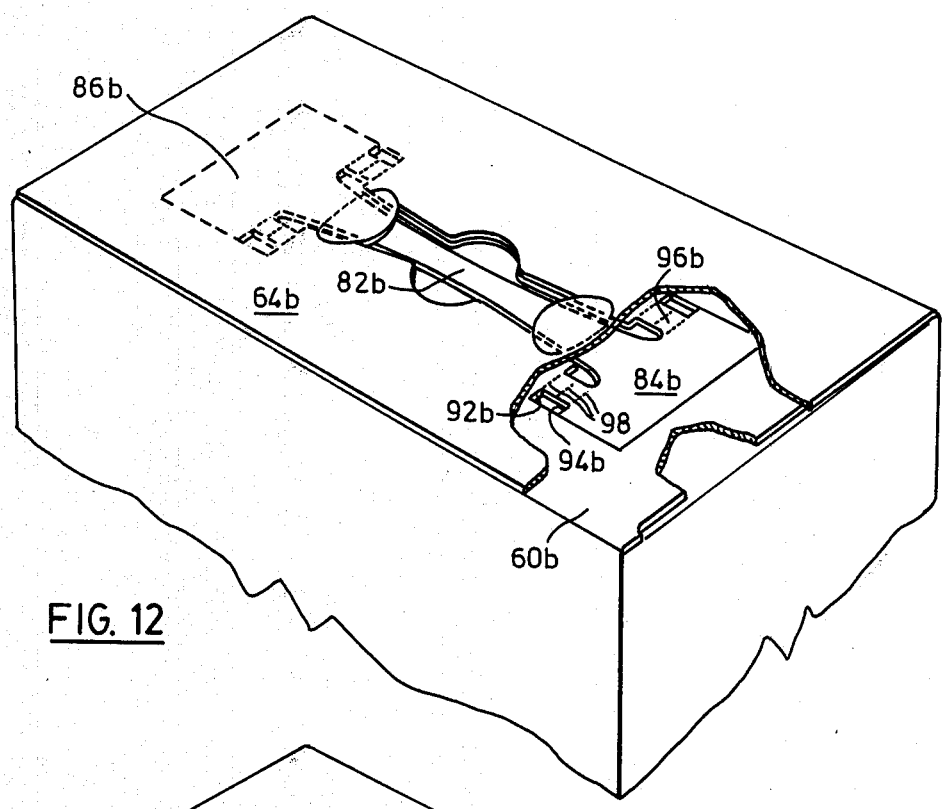
Figure 13:
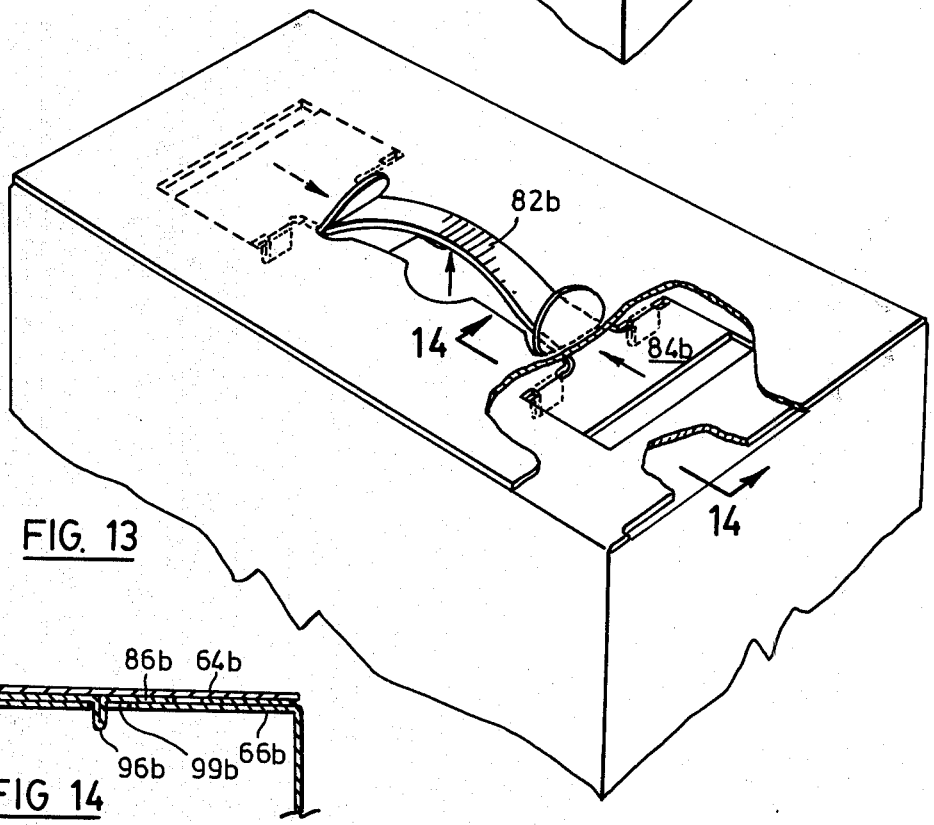
Figure 14:
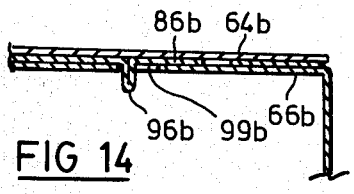
Figure 15:
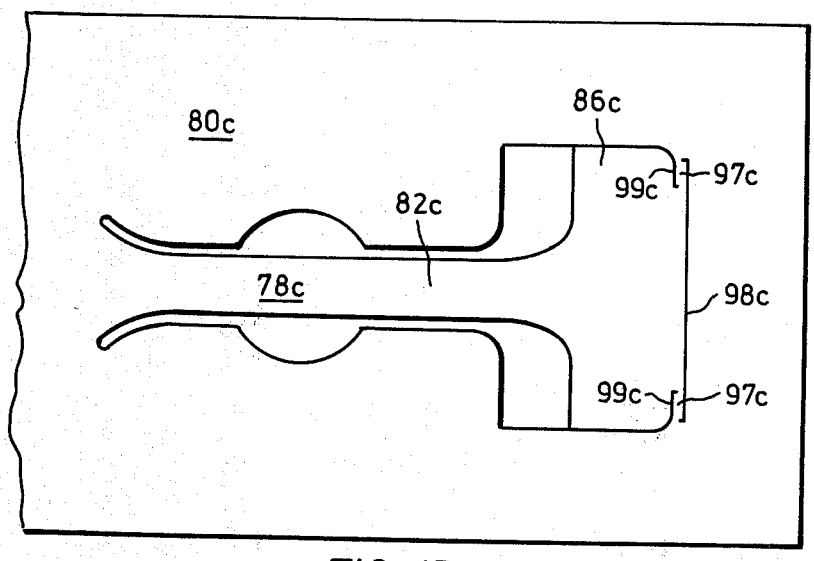
Figure 16:
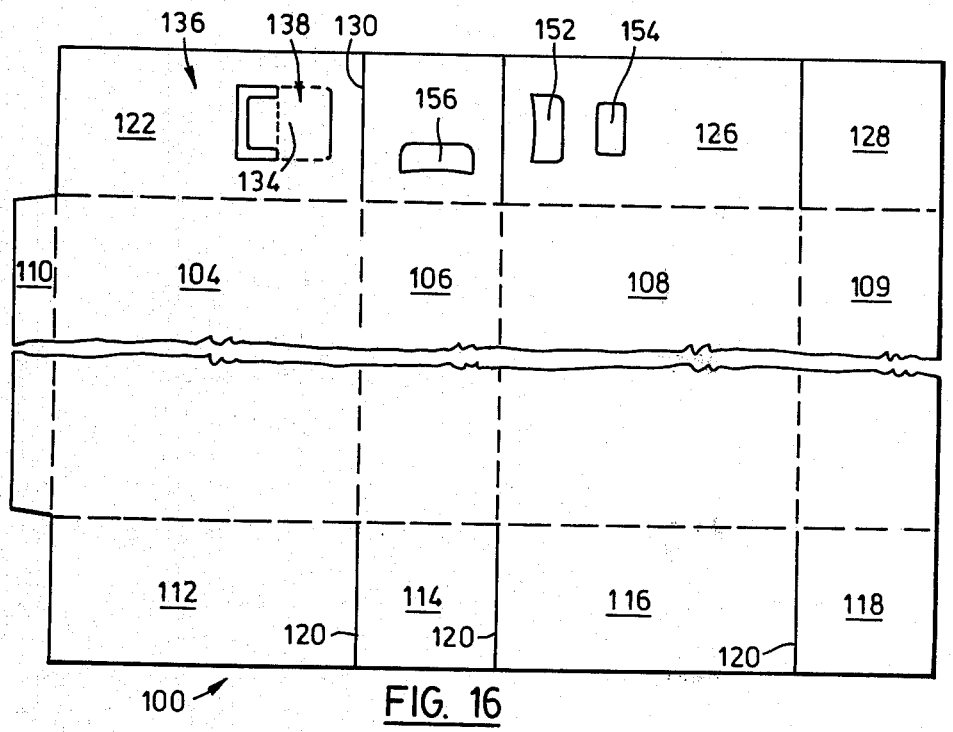
Figure 16A:
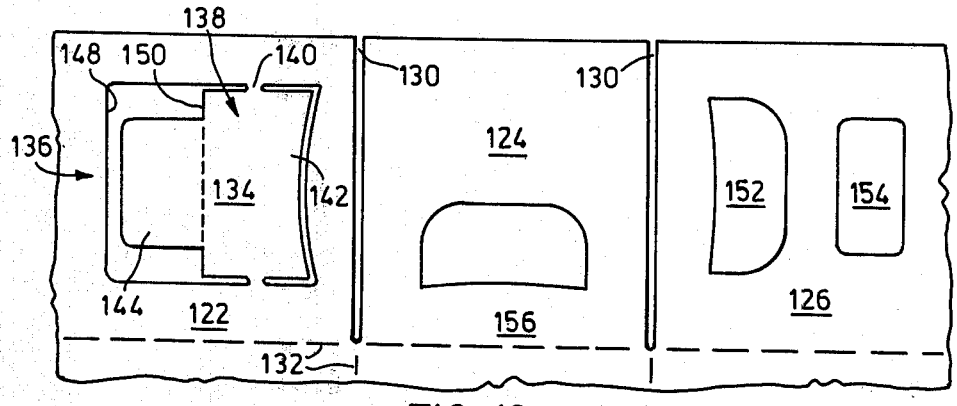
Figure 17:
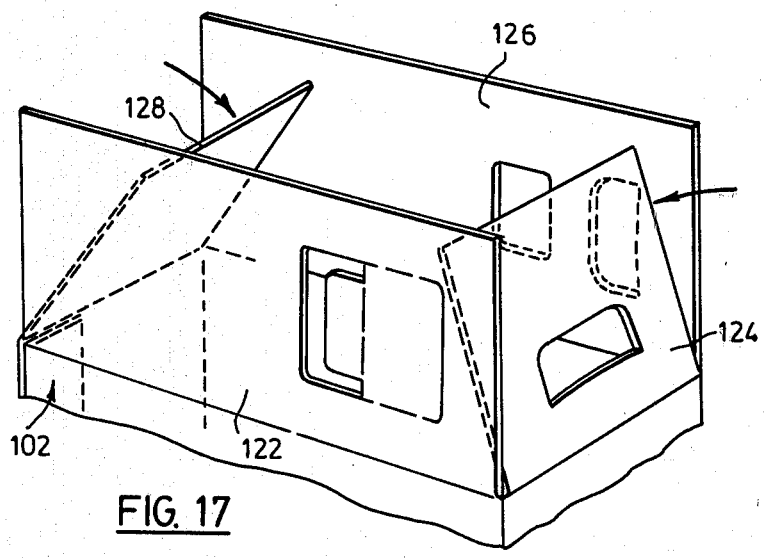
Figure 18:
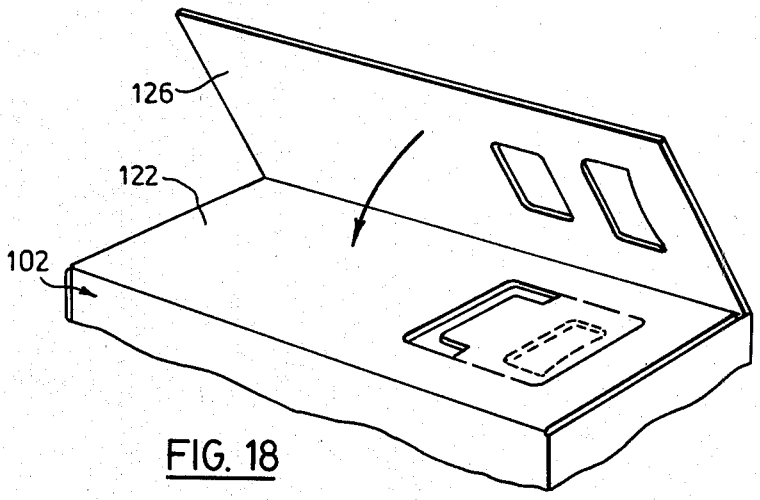
Figure 19:
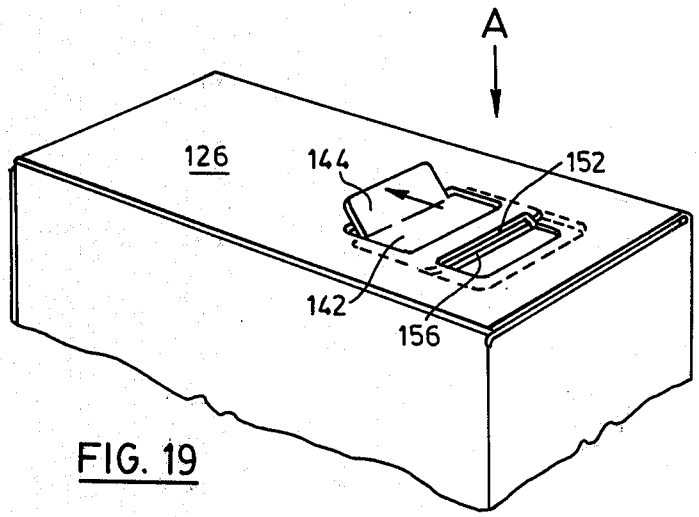
Figure 21:
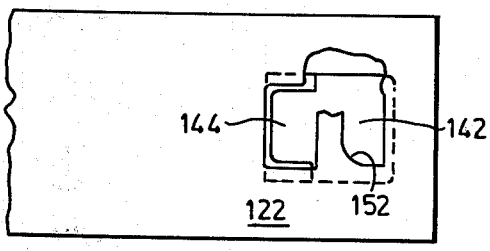
Figure 20:
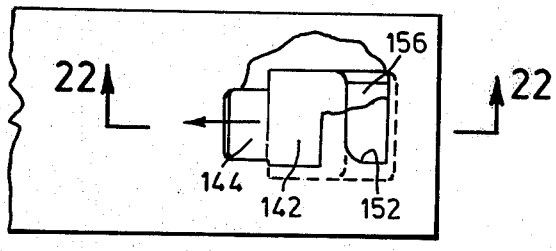
Figure 22:
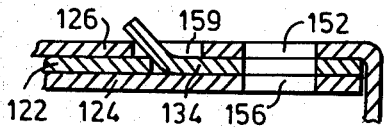
Figure 23:
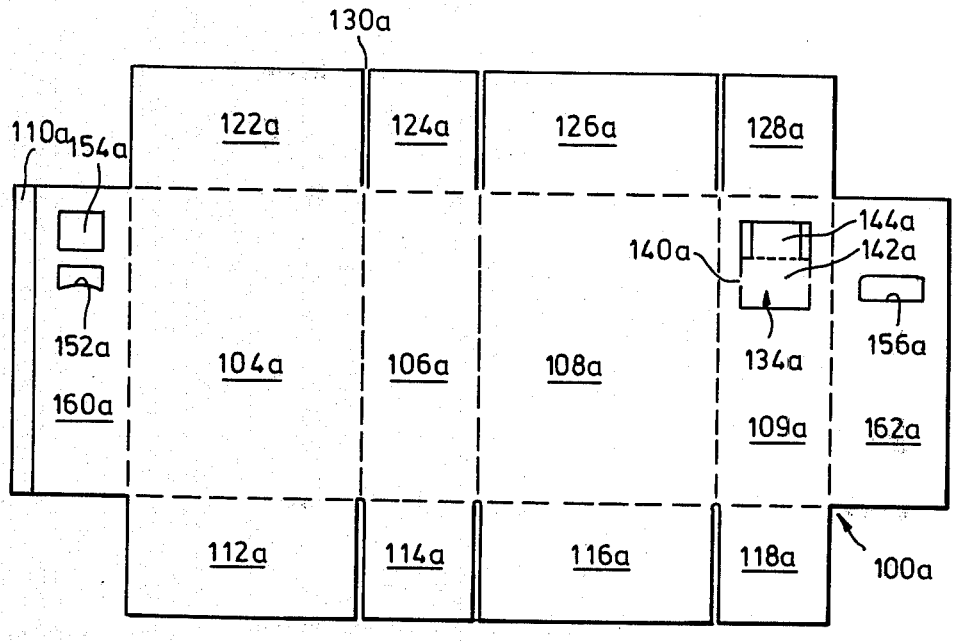
Figure 24:
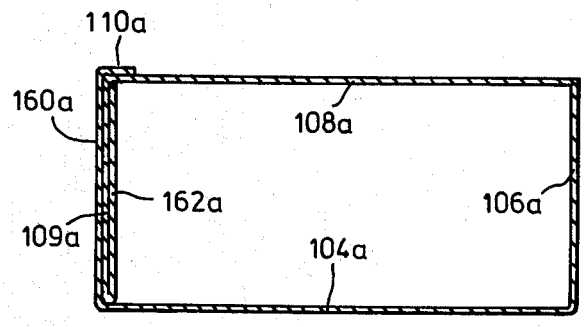

FIG. 2*a* is an enlarged view of a portion of the blank shown in FIG. 2;

FIG. 3 is a perspective view showing the initial stages in assembly of the blank of FIG. 2;

FIG. 4 is a perspective view, similar to FIG. 3 showing further stages in the assembly of the blank of FIG. 2;

FIG. 5 is a perspective view showing the carton assembled from the blank of FIG. 2, parts of the carton being removed for clarity;

FIG. 6 is a view similar to FIG. 5 showing the handle of the carton in the raised condition;

FIG. 7 is a section on the line 7—7 of FIG. 5;

FIG. 8 is a plan view of a second embodiment of a carton blank formed on the machine of FIG. 1;

FIG. 9 is a perspective view of the carton assembled from the blank of FIG. 8 with a portion removed for clarity;

FIG. 10 is a view similar to FIG. 9 showing the handle of the carton in the raised position;

FIG. 11 is a plan view of a third embodiment of a blank produced on the machine of FIG. 1;

FIG. 12 is a view showing the carton assembled from the blank of FIG. 11;

FIG. 13 is a view similar to FIG. 12 showing the handle of the carton in a raised position;

FIG. 14 is a view of the line 14—14 of FIG. 13;

FIG. 15 is a plan view on an enlarged scale showing a portion of a further embodiment of a blank produced on the machine of FIG. 1;

FIG. 16 is a plan view of a blank formed on the machine of FIG. 1 to form a carton with a pouring spout;

FIG. 16*a* is an enlarged view of a portion of the blank of FIG. 16;

FIG. 17 is a perspective view showing the blank of FIG. 16 during initial stages of assembly;

FIG. 18 is a perspective view similar to FIG. 17 showing the blank during final stages of assembly;

FIG. 19 is a perspective view showing the carton assembled from the blank of FIG. 16 with the pouring spout in an open position;

FIG. 20 is a plan view in the direction of arrow A in FIG. 19 with portion of the carton removed for clarity;

FIG. 21 is a plan view similar to FIG. 20 showing the pouring spout in a closed position;

FIG. 22 is a section on the line 22—22 of FIG. 20;

FIG. 23 is a plan view of a blank arranged to provide a spout in one side face of a carton;

FIG. 24 is a section of a portion of a carton formed from the blank of FIG. 23.

Referring now to FIG. 1 a carton forming apparatus 10 comprises a multi stage printing press 12, a die cutting press 14 and a folding and gluing machine 16. Web material 18, usually a folding board is taken from a roll 20 and fed through the printing press 12 to print the exterior design on the carton. The web 18 then passes over a tape applicator 22 which feeds lengths of adhesive tape 24 into engagement with a predetermined area of the web 18. The tape 24 is fed from a roll 26 and severed by a knife 28 into the required length. A pair of pinch rollers 30 operate periodically and in synchronism with the feed of web material to feed the tape 24 onto the web 18 at a predetermined location.

Alternatively, the tape 24 may be in the form of precut labels which are fed by a known label applicator onto the web 18. Such applicators are available from a number of manufacturers, one suitable applicator being known as Label-Aire (Registered Trade Mark) manufactured by Label-Aire Incorporated of Fullerton, California.

The tape 24 may be preglued or may have glue applied to it as it moves toward the web 18. A suitable material for the tape 24 is available commercially under the trade name Fabrene from DuPont.

The die cutting press 14 receives the printed web 18 cuts it into blanks 34 of the required shape and generates fold lines to divide the blank into a number of planar areas.

The blanks 34 are fed singly into the folding and gluing machine 16 which folds the blank, applies adhesive to the appropriate areas of the blank and assembles the blank into a carton 38 of the required shape. In most cases, the carton will be folded and glued in the machine 16 into a generally flat shape to facilitate delivery to the end user. The carton 38 is subsequently formed, filled and sealed on a carton erecting and sealing machine (not shown) which will initially form the carton with one end open, fill the carton, and subsequently seal it.

The operation of the printing press 12, die cutting press 14, and gluing machine 16, and carton erecting and sealing machine are well known to those skilled in the art and need not be elaborated further for a complete understanding of the present invention.

One embodiment of the blank 34 is shown in FIG. 2 and includes front and rear panels 40, 44 interconnected by a side panel 42. A second side panel 46 is connected to the rear panel 44 and upon folding, will overlie a tab 48 (commonly known as the manufacturers joint) extending laterally from the front panel 40. Lower end flaps 50, 52, 54, 56 extend from lower edges of the front panel 40, side panel 42, rear panel 44 and side panel 46 respectively. Slots 58 are formed between the lower end flaps up to their junction with the respective panel to permit folding of the blank.

Upper end flaps 60, 62, 64, 66 are similarly formed along the upper edges of the front panel 40, side panel 42, rear panel 44 and side panel 46 respectively and are separated by slots 68 extending to their junction with the panels.

The upper and lower end flaps 64, 54 are known as the outer major flaps, the upper and lower end flaps 60, 50 are known as the inner major flaps and the end flaps 52, 56, 62, 66 are known as the minor dust flaps. This terminology will be used in the subsequent description for clarity.

The periphery of each of the panels is delimited by crease lines 70, indicated by chain dot lines, which are formed during the die cutting process to assist in the discrete folding operation so that the blank is divided into a number of planar areas.

During the die cutting of the blank 34, an elongate aperture 72 having a pair of recesses 74 and a stop 76 at each end is cut into the upper outer major flap 64.

The tape 24 applied prior to die cutting is positioned on the upper inner major flap 60 on the blank 34. During the die cutting, the upper inner major flap 60 is formed into first and second portions 78, 80 respectively with the tape 24 overlying the first portion and extending partially into the second portion 80. If preferred, the tape 24 may be pre-cut to the required shape prior to application although it is believed that the cutting of the tape during die cutting is more economical.

The blank of FIG. 2 is intended to provide a carton having a carrying handle and therefore the first portion 78 is formed in the shape of a handle having a strap 82 extending between end members 84, 86. The upper inner major flap 60 is shown in greater detail in FIG. 2*a* where it may be seen that bridge members 88 interconnect the first and second portions 78, 80. The bridge members 88, which constitute one form of deformable connection between the portions 78, 80, are formed during die cutting by interrupting the cutting edge used to cut the periphery of the first portion 78. The locations of the bridge members 88 are chosen so that the first portion 78 is maintained in stable planar configuration with the second portion and the bridge members are dimensioned to sever upon application of a nominal force acting to pull the strap 82 out of the plane of the flap 60.

The periphery of the second portion 80 is spaced from the strap 82 and is provided with recesses 90 of similar configuration to the recesses 74. A portion of inner major flap 60 is also removed between the first and second portions 78, 80 adjacent the end members 84, 86 to provide spaced abutment edges 92, 94 which extend transverse to the strap 82. Thus, limited relative movement between the first and second portions is accommodated upon severance of the bridge members 88.

The initial stages of assembly of the carton 38 from the blank 34 are shown in FIG. 3. The blank 34 is folded through 90° along each of the crease lines 70 separating the panels 40, 42, 44, 46 and adhesive applied to the outer surface of the tab 48. The inner surface of the end panel 46 is then brought into engagement with the adhered surface of the tab 48 to hold the blank in an open ended cube configuration. The upper minor dust flaps 62, 66 are then folded toward one another so that their edges abut and form a continuous planar end surface for the carbon 38.

Adhesive is applied to selected areas of the minor dust flaps 62, 66, indicated by hatching, either prior or subsequent to folding, and the upper inner major flap 60 folded into engagement with the minor dust flaps 62, 66. As the hatching indicates, the areas to which the adhesive is applied to the minor dust flaps 62, 66 are chosen to avoid the first portion 78 and thereby ensure that it is free to move relative to the second portion. This selective application of glue may be achieved by providing a varnish coating to prevent the glue adhering to the unpatched areas or by arranging the glue coating apparatus which corresponds in shape to the area to be coated.

Folding of the blank 34 continues by applying adhesive to the upwardly facing surface of the second portion 80 and then folding the upper outer major flap 64 down onto the upper inner major flap 60 as shown in FIG. 4. The end of the carton 38 is thus completed and provides the configuration shown in FIG. 5 with the glue acting to restrain separation of the outer major flap 64 and inner major flap 60.

The carton 38 is therefore sealed at one end by a wall defined by the end flaps 60, 62, 64, 66, and is open to receive the contents at the other. After filling, the lower end flaps 50, 52, 54, 56 are folded and glued in a similar manner to that described above to seal completely the carton.

Although FIGS. 3 and 4 illustrate the folding of the blank 34 with the flaps 60–66 uppermost, it will be appreciated that this may be accomplished in the folded machine with the flaps 60–66 at the bottom. This enables the carton to be in the correct orientation for subsequent filling. Alternatively, the lower end flaps 50–56 may be folded and sealed first and the upper end flaps folded and sealed after the filling operation.

The aperture 72 is located on the blank 34 to overlie the strap 82 with the recesses 74 in register with the recesses 90 when the carton 38 is assembled. The aperture 72 therefore permits access to the strap 82 with the recesses 74, 90 providing sufficient room to grip the strap and pull it through the aperture when desired. Therefore, after the carton 38 is filled and sealed a carrying handle is provided by simply grasping the strap 82 through the aperture 72 and pulling the strap upward. This severs the bridge members 88 so that the first portion 78 is free to move relative to the second portion 80.

Because the upper inner major flap 60 is located between the minor dust flaps 62, 66 and upper outer major flap 64 (as best illustrated in FIG. 7), the end members 84, 86 are constrained to slide in the plane of the second portion 80. This causes the abutment edges 92, 94 to move into engagement and inhibit further relative movement between the first and second portions 78, 80. Since the end members 84, 86 are wider than the aperture 72, the strap 82 is retained in the carton and projects above the upper end flap 64 to provide a convenient carrying handle in the manner shown in FIG. 6. The tape 24 provides a local reinforcement to ensure adequate strength for the strap 82 and the upper minor dust flaps 66, 62 ensure that a continuous surface is presented to the interior of the carton to maintain its sealed integrity. The force required to break the bridge members 88 should be less than the total weight of the carton when filled so that the handle is formed prior to the carton 38 being lifted.

It will be seen that the handle is provided in a simple convenient manner without resorting to additional components and without complicating the folding procedure.

A second embodiment of a blank to provide a carrying handle is shown in FIGS. 8 to 10. Since the arrangement is similar to that shown in FIGS. 2 to 7 like reference numerals will be used to denote like parts with a suffix "a" added for clarity of description. In the arrangement of FIG. 8, a strap **82*a* is provided with only one end member 84*a*. The opposite end of the strap 82*a* to the end member 84*a* connects across its full width with the second portion 80*a* of the upper inner major flap 60*a* so that relative movement between the first and second portions 78*a*, 80*a* occurs at one location only. Although this reduces the cutting required to form the first portion 78*a*, the spacing between the abutment edges 92*a*, 94*a* must be increased to achieve the same projection of the strap 82*a* above the upper end flap 64*a***.

FIGS. 11 to 14 show a further arrangement of carton blank to provide an integral carrying handle. Again, like reference numerals denote like parts with a suffix "b" added for clarity of description. The arrangement of FIGS. 11 to 14 is similar to that of FIGS. 2 to 7 but the bridging members **88*b* are modified to provide a folding action rather than severing action. In this case, the bridging members 88*b* are in the form of webs 96*b* which extend between adjacent abutment edges 92*b*, 94*b*. Score lines 98*b* extend parallel to the abutment edges 92*b*, 94*b* and provide lines of weakness to promote folding action. The upper minor dust flaps 62*b*, 66*b* include square holes 99*b* which are positioned to be aligned with the webs 96*b*** when the carton is assembled.

The carton is folded and filled as described above and a handle provided by pulling upwardly on the strap **82*b*. This force causes the webs 96*b* to fold and the abutment edges 92*b*, 94*b* move into engagement. As can best be seen in FIG. 14, the folded webs 96*b* are accommodated by the respective square holes 99*b* and project into the interior of the carton 38**.

FIG. 15 shows a further arrangement for providing an integral carrying handle with like reference numerals denoting like parts, the suffix "c" being added for clarity of description. The arrangement is similar to that shown in FIG. 8 in that relative movement between the first and second portions **78*c*, 80*c* occurs at only one end of the strap 82*c*. The bridging members 88*c* are formed as two webs 97*c* which are defined between cuts 98*c* 99*c* made during the diecutting process to delimit the first and second portions 78*c* 80*c*. The cut 98*c* extends generally transverse to the axis of the strap 82*c* and terminates within the width of the end member 86*c*. Cuts 99*c* define the corners of the end member 86*c* and are spaced from but partially overlap the cut 98*c***.

Upon application of a force to the strap **82*c*, the webs 97*c* yield adjacent the ends of the cuts 98*c*, 99*c* to permit the second portion 80*c* to move relative to the first portion 78*c* as shown in chain dotted lines. The webs 97*c*** are subject to a tearing action which has been found to reduce the force required to separate the first and second portions. At the same time, it is possible to provide a continuous cutting edge which facilitates manufacture of the die cutting plates.

As a further modification to the above arrangements, the strap **82*a* may be removed during die cutting and the tape 24 applied subsequently to extend between and connect the end members 84, 86**.

In all the above embodiments, the blank 34 is cut to provide a carrying handle for a carton. In the embodiment shown in FIGS. 16 to 24 a blank 100 is cut to provide a carton 102 with a pouting spout. The blank 100 is formed on the carton forming machine 10 of FIG. 1. As can be seen in FIG. 16, the blank 100 includes front panel 104, side panel 106, back panel 108 and side panel 109. A tab 110 extends from the longitudinal edge of the front panel 104 opposite the side panel 106. Lower end flaps 112, 114, 116, 118 extend downwardly from the front, side, back and side panels respectively and are separated by slits 120 which extend up to the panels to permit folding. Upper end flaps 122, 124, 126, 128 extend upwardly from the front, side, back and side panels respectively and are separated by slits 130 to permit folding of the blank into an assembled carton 102. As in the previous embodiments, the end flaps 114, 118 and 124, 128 are commonly referred to as minor dust flaps, the end flaps 112, 122 are referred to as inner major flaps and the end flaps 116, 126 referred to as outer major flaps. This terminology will again be used for clarity. The panels 104–109 are delimited by crease lines 132 which are formed during the die cutting and define the edges of the assembled carton.

As can be seen in FIGS. 17 and 18, the carton 102 is assembled by folding the panels along crease lines 132 so that the tab 110 contacts the internal surface of side panels 109 and is adhered thereto. The lower minor dust flaps 114 and 118 are folded toward one another and the lower inner minor flap 112 folded on top. The end of the carton 102 is sealed by folding the lower outer major flap 116 onto the flap 112 and securing it with adhesive.

The opposite end of the carton 102 is sealed in a similar manner by folding the upper minor dust flaps 124, 128 toward one another so that their edges abut, and then folding the inner major flap 122 onto the surface provided by the flaps 124, 128. Adhesive is placed in required areas between the surfaces prior to folding to secure the flaps in place.

The outer major flap 126 is then folded onto the upwardly facing surface of the inner major flap 122 and secured with adhesive.

It will be appreciated that the above operations are performed by the folding machine and one of the ends may be left open to facilitate filling and subsequent sealed.

In order to provide a pouring spout for the carton 102, the upper end flaps are formed with a number of cut-outs during the die cutting process as may best be seen in FIG. 16*a* which cooperate when the flaps are folded to define a spout.

A closure member 134 divides the upper inner major flap 122 into first and second portions 136, 138 respectively which are interconnected by bridge members 140. The closure member 134 includes a sealing portion 142 and a pull tab 144 which are delimited by a crease line 146. A portion of the upper inner major flap 122 surrounding the pull tab 144 is removed to space the pull tab 144 from the first portion and provide a pair of spaced abutment edges 148, 150 on the first portion and closure member respectively.

The upper outer major flap 126 is formed with first and second apertures 152, 154 which respectively overlie the sealing portion 142 and pull tab 144 when the flaps are folded in the manner shown in FIG. 17. The minor dust flap 124 includes a third aperture 156 which is aligned with the first aperture 152. With the flaps folded, the upper inner major flap 122 lies between the minor dust flap 124 and the outer major flap 126 so that the second aperture 154 provides access to the pull tab 144 and the sealing portion 142 controls flow between the first aperture 152 and the third aperture 156. To open the pouring spout for the carton 102 it is simply necessary to lift the pull tab 144 and pull in the direction of the arrow B in FIG. 18. This force severs the bridge members 140 and frees the closure member 134 for sliding movement between the flaps 126, 124. As the closure member 134 is pulled in the direction of arrow B, the sealing portion 142 uncovers the first and third apertures 152, 156 to permit the contents to flow from the carton 102. The spaced edges 148, 150 limit movement of the closure member 134 relative to the first portion to prevent movement beyond a fully open position.

The carton 102 may be simply resealed by sliding the closure members 134 in an opposite direction to the arrow B until the sealing portion 142 once again covers the third aperture 156. It will be noted that the width of the first and third apertures is slightly less than the width of the sealing portion 142 so that the edge of the sealing portion is guided by the flaps 124, 126. Similarly, the width of the second portion is less than the width of the sealing portion to inhibit the flap from being pulled from the carton 102. By providing a pouring spout in the above manner, it will be appreciated that the blank 100 remains in a planar format and avoids the need for additional components. The closure member 134 is slidably supported between the minor dust flap 124, and outer major flap 126 so that loss of the closure member is avoided. Gluing of the flaps is of course arranged so as not to infere with the sliding movement of the closure member and this may be accomplished in the manner described above with reference to the handle.

If desired folding bridging members, similar to those used in the embodiment of FIGS. 11 to 15, could be used to interconnect the first and second portions. Also, if there is no requirement for a resealable container, then the apertures in the flaps may be dimensioned to permit the closure member to be pulled laterally from the carton.

In the embodiments shown and described above, the supplementary components have been formed in an end surface of the finished carton. It may be desirable to provide such a component on a side face of the carton, particularly in the case of a pouring spout. FIG. 23 shows a suitable blank for providing this arrangement, which may of course be used in combination with a handle in the end surface if desired. Parts similar to those shown in the embodiment of FIGS. 17 to 22 are denoted by the same reference numeral even though their orientation may have changed and a suffix "a" has been added for clarity.

The blank 100*a* includes front, back and side panels 104*a*, 108*a*, 106*a*, 109*a*; end flaps 112*a*–128*a* and a securing tab 110*a* as described above. An additional side panel 160*a* is interposed between the tab 110*a* and front panel 104*a* with first and second apertures 152*a*, 154*a* cut into the upper portion of the panel 160*a*.

A closure member 134*a* is formed in the side panel 109*a* and secured to the side panel 109*a* by bridge members 140*a*. The closure member 134*a* includes a sealing portion 142*a* and pull tab 144*a* which are aligned with the apertures 152*a* and 154*a* respectively. The blank 100*a* is extended beyond the panel 109*a* to provide and a panel 162a which includes the third aperture 156a aligned with the first aperture 152a.

To assemble the blank 100a into a carton, the panel 162a is folded and glued onto the inner face of the panel 109a. The interface of the panels adjacent the closure member 134a is left unglued to permit its free movement and of the blank 100a is then folded into an open cube configuration with the tab 110a engaging the edge portion of the panel 108a. In this position, the panel 160a overlies the panel 109a so that the closure member 134a is aligned with the first end second apertures 152a, 154a.

The tab 110a is glued to the side panel 108a to hold the blank 100a in its folded configuration and glue applied between the panels 160a and 109a to hold them together. Again, glue is avoided in the vicinity of the closure member 134 so as not to inhibit its free movement. The carton may then be assembled, filled and sealed in the conventional manner described above. To open the carton, the pull tab 144a may be grasped through the second appeture 154a and the bridge members broken to allow the closure member 134a to slide relative to the panel 109a. This will uncover the first aperture 152a to allow the contents of the carton to the dispensed. The closure member 134a may be slid back to seal the carton.

Obviously, a similar arrangement may be used to provide a handle by joining the inner and outer major panels and folding the inner major panel back to lie under the outer major panel.

It will be seen therefore that in all the above embodiments, a supplementary component is provided without resorting to additional separate items and without complicating the assembly procedure.

The embodiment of the invention in which an exclusive property or privilege is claimed are defined as follows:

1. A carton including a pair of planar members adapted to overlie one another, one of said planar members having first and second portions interconnected by at least one deformable connection, an abutment edge on each of said portions, said edges being arranged in spaced relationship to permit relative movement between said first and second portions, a reinforcing tape adhered to said one planar member and completely overlying said first portion and extending onto the inner periphery of said second portion, an aperture formed in the other of said planar members to permit access to said first portion and restraining means acting between said planar members to prevent separation thereof whereby upon a force being applied to said one portion, said connection deforms and permits relative movement between said first and second portions.

2. A carton according to claim 1 wherein a further planar member is provided and said one planar member is located between said other planar member and said further planar member.

3. A carton according to claim 1 wherein said abutment edges move into abutment upon said relative movement.

4. A carton according to claim 3 wherein said deformable connection includes a bridge member having at least one score line parallel to said abutment edge whereby said bridge member folds upon application of a force to permit said edges to move into abutment.

5. A carton according to claim 3 wherein said deformable connection includes at least one severable connection which breaks upon application of a force to move said edges toward one another.

6. A carton having walls formed from a unitary blank one of said walls being constituted by a pair of planar wall members, one of which overlies the other, said other of said wall members having a local reinforcement provided by a tape adhered to said other wall member, the portion of the other wall member completely covered by said tape including a sliding portion, a fixed portion, and deformable connecting means joining said sliding and fixed portions, means being provided on said other wall to permit limited sliding movement between said sliding and fixed portions, said one wall also including means preventing separation of said sliding portion from said wall and means to permit access to said sliding portion to cause said limited sliding movement.

7. A carton according to claim 6 wherein said means to permit access includes an aperture in said one wall member overlying said sliding portion.

8. A carton according to claim 7 wherein said means preventing separation includes a pair of stop members on said first portion and extending beyond said aperture, said stop members cooperating with said one wall member adjacent said aperture to prevent separation of said first portion.

9. A carton according to claim 8 wherein said connecting means includes a deformable connecting member.

10. A carbon according to claim 9 wherein said connecting member is severable upon application of a force to cause said sliding movement.

11. A carton formed from a unitary blank and having a carrying handle formed integrally therewith, said carton including a wall constituted by a pair of wall members one of which overlies the other, said other wall member having a handle portion and a fixed portion interconnected by deformable bridge members, said handle portion and fixed portion being reinforced by a tape adhered to said other wall member so as to cover said handle portion and extend into said fixed portion, said portions having spaced edges to permit movement of said handle portion relative to said fixed portion in a first direction upon application of a force to said handle portion, said one wall member having an aperture overlying said handle portion to permit access thereto, and restraining means acting on said handle portion to prevent separation of said handle from said one wall.

12. A carton according to claim 11 wherein said restraining means includes a pair of stop members extending transverse to said first direction a distance greater than the width of said aperture, said stop members cooperating with said one wall member adjacent said aperture to prevent separation of said handle portion.

13. A carton according to claim 12 wherein said one wall includes a further wall member underlying said other wall-member, said further wall member constraining said stop members to slide in the plane of said other wall member.

14. A planar unitary blank for producing a carton, said blank having a first planar area having a first portion and a second portion connected by bridging members so as to lie in the plane of said blank, said first planar area having an area of local reinforcement by a tape adhered to said first planar area to completely cover said first portion and the inner periphery of said second portion, said first planar area having portions removed intermediate said first and second portions to accommodate limited sliding movement between said first and second portions, whereby during assembly of said carton, said bridging members maintain said portions in co-planar relationship and, upon assembly, the application of a force to one of said portions deforms said bridging members to permit said relative sliding movement.

15. A blank according to claim 14 wherein an aperture is provided in a second planar area so that upon assembly of said carton, said aperture overlies said one portion to permit access thereto.

16. A method of providing a handle on a carton comprising the steps of forming first and second discrete areas on a blank, adhering a tape to completely cover said first area to provide a zone of localised reinforcement, providing in said zone a handle portion and a remaining portion with said handle portion connected to the remaining portion of said area by a deformable connection, removing a portion of said first area to permit relative movement between said handle portion and said remaining portion, providing an aperture in said second area and folding said second area over said first area so that said aperture overlies said handle portion and permits access thereto.

17. A method according to claim 16 including the additional step of providing a third area on said blank and folding said third area beneath said first area to constrain said handle portion for relative movement in the plane of said second area.

18. A method according to claim 16 wherein said tape is adhered to said blank prior to formation of said handle portion.

19. A method of forming a carton having an integral handle comprising the steps of applying an adhesive tape to a predetermined area of a web of material from which the carton is to be formed, cutting from said web a blank to be folded into said carton, removing a portion of said predetermined area to define a handle connected by deformable connections to the remainder of said blank, the removed portion of the blank permitting relative movement between the handle and remainder of the blank, forming an aperture in the remainder of the blank and folding said blank so that said aperture overlies said handle and permits access thereto, said tape thereby providing a reinforcement for said handle.

* * * * *